US005273276A

United States Patent [19]

Warren

[11] Patent Number: 5,273,276

[45] Date of Patent: Dec. 28, 1993

[54] BASKETBALL REBOUND DEVICE

[76] Inventor: William R. Warren, Rte. 1, Box 225, Castor, La. 71016

[21] Appl. No.: 44,940

[22] Filed: Apr. 8, 1993

[51] Int. Cl.[5] ..... A63B 69/00

[52] U.S. Cl. ..... 273/1.5 A

[58] Field of Search ..... 273/1.5 A, 394–396

[56] References Cited

U.S. PATENT DOCUMENTS

| | | | |
|---|---|---|---|
| 2,889,149 | 6/1959 | Williams | 273/103 |
| 3,427,026 | 2/1969 | Mahoney | 273/395 X |
| 3,752,476 | 8/1973 | Mahoney | 273/1.5 A |
| 3,814,421 | 6/1974 | Spier, Jr. | 273/1.5 A |
| 4,786,052 | 11/1988 | Zinger | 273/1.5 |
| 5,039,109 | 8/1991 | Mahoney et al. | 273/395 |
| 5,060,940 | 10/1991 | Mullen | 273/1.5 A |
| 5,141,224 | 8/1992 | Nolde et al. | 275/1.5 |

OTHER PUBLICATIONS

Basketball Coaching and Training Aids, 1989 School Mail Order Catalog, Korney Board Aids p. 16 "Shot Shager", Toss Back.

*Primary Examiner*—Paul E. Shapiro

*Attorney, Agent, or Firm*—Warner J. Delaune, Jr.; Robert C. Tucker; William David Kiesel

[57] ABSTRACT

A basketball rebound device is provided comprising a rebound panel positioned beneath the goal rim and adapted to deflect the basketball away from the goal assembly upon the basketball being received through the rim; a mounting brace attachable to the goal post and including a vertical sleeve attached to the mounting brace; a primary support member having a lower end which is slidably matable within the vertical sleeve, and having an upper end extending away from the goal post; a first lock connected between the vertical sleeve and the lower end of the primary support member for locking the primary support member relative to the vertical sleeve; a secondary support member slidably matable within the primary support member; a second lock connected between the primary support member and the secondary support member for locking the secondary support member relative to the primary support member; and a lockable pivot connected between the rebound panel and the secondary support member for allowing angular manipulation of the rebound panel relative to the secondary support member.

9 Claims, 4 Drawing Sheets

BASKETBALL REBOUND DEVICE

BACKGROUND OF THE INVENTION

I. Field of the Invention

The present invention relates generally to attachments for basketball goals which use a post fixed in the ground, and more particularly to rebound devices attachable to the post for returning a basketball to a practicing player.

II. Description of Prior Art

When a person shoots a basketball toward a basketball goal, the direction of travel of the ball after it has gone through the net is oftentimes unpredictable. If the player is lucky, the ball will slowly bounce back directly to the player after the shot. Most of the time, however, the ball either bounces to a stop underneath the goal, or rolls away to the side. This scenario can be very frustrating for the player who wishes to practice a particular shot from a fixed position, because it (1) breaks the concentration of the player and (2) causes the player to chase after the ball between each shot.

A wide variety of devices have been developed for returning a basketball to a player under these conditions. The primary objective of all these inventions is to facilitate the shooting aspect of basketball practice by allowing the player to shoot from a fixed position and have the ball immediately returned to him.

One such device disclosed in Williams (U.S. Pat. No. 2,889,149) is a coordination training device for children comprising a return device attached to the goal support post. It is designed for very close quarters and can only return the ball within a predetermined arc to a semi-circle of children ready to received the rebounded ball. While it provides some vertical adjustability, this adjustment must be inconveniently made directly at its attachment to the pole. In addition, there is no adjustment for horizontal angle, so it is not versatile enough for adult players desiring to develop their shooting skills from large distances from the goal or from particular points around the goal.

Two other return devices are disclosed in Zinger (U.S. Pat. No. 4,786,052) and Nolde, et al. (U.S. Pat. No. 5,141,224) which each include a downwardly inclined deflector surface attached to the backboard of the goal underneath the net. The Nolde device has the advantage of being easily removable, whereas the Zinger device is permanently attached. While these rebound devices can be used by adults, they are apparently limited to returning only "free throw" shots, because neither device offers any adjustability with respect to shot angle.

Various other means have been developed to return the basketball to the practicing player, but they are either attached to the goal rim or backboard, or they are too mechanically complex. Therefore, there is a need for a basketball rebound device for use by adults which (1) can be easily attached to the goal support post, (2) offers adjustability with respect to the height of the rebound surface relative to the goal rim, (3) offers adjustability to compensate for the difference in distances between the support post and the goal rim, and (4) offers angular adjustability of the rebound surface, all so that shots can be practiced from virtually any angle from the goal.

SUMMARY OF THE INVENTION

It is therefore an object of this invention to provide a basketball rebound device which can be vertically adjusted relative to the goal rim.

It is also an object of this invention to provide a basketball rebound device whose rebound surface can be angularly adjusted to accommodate a variety of shooting angles.

It is another object of this invention to provide a basketball rebound device which can be adjusted to compensate for differences in distance between the support post and the goal rim.

It is a further object of this invention to provide a basketball rebound device which is attachable to the goal support post.

Yet another object of this invention is to provide a basketball rebound device which can be easily moved to a position of non-use when desired.

These and other objects and advantages of the present invention will no doubt become apparent to those skilled in the art after having read the following description of the preferred embodiment which are contained in and illustrated by the various drawing figures.

Therefore, in a preferred embodiment, and in combination with a basketball goal assembly, the goal assembly including a support post, a backboard attached to the support post, and a forwardly extending goal rim attached to the backboard for receiving a basketball thrown by a player, a basketball rebound device, comprising a rebound panel positioned beneath the rim and adapted to deflect the basketball away from the goal assembly upon the basketball being received through the rim; a mounting brace attachable to the post, the mounting brace having a front portion and a rear portion, and including a first vertical sleeve attached to the front portion; a primary support member, having a lower end and a hollow upper end, wherein the lower end is slidably matable within the first vertical sleeve and wherein the upper end extends away from the support post; a first locking means operatively connected between the first vertical sleeve and the lower end of the primary support member for locking the primary support member relative to the first sleeve; a secondary support member, having a first end and a second end, wherein the first end is slidable matable within the hollow upper end of the primary support member; a second locking means operatively connected between the upper end of the primary support member and the second end of the secondary support member for locking the secondary support member relative to the primary support member; and a lockable pivot means operatively connected between the rebound panel and the second end of the secondary support member for allowing angular manipulation of the rebound panel relative to the secondary support member.

DETAILED DESCRIPTION OF THE PREFERRED EMBODIMENT

Figure 1:
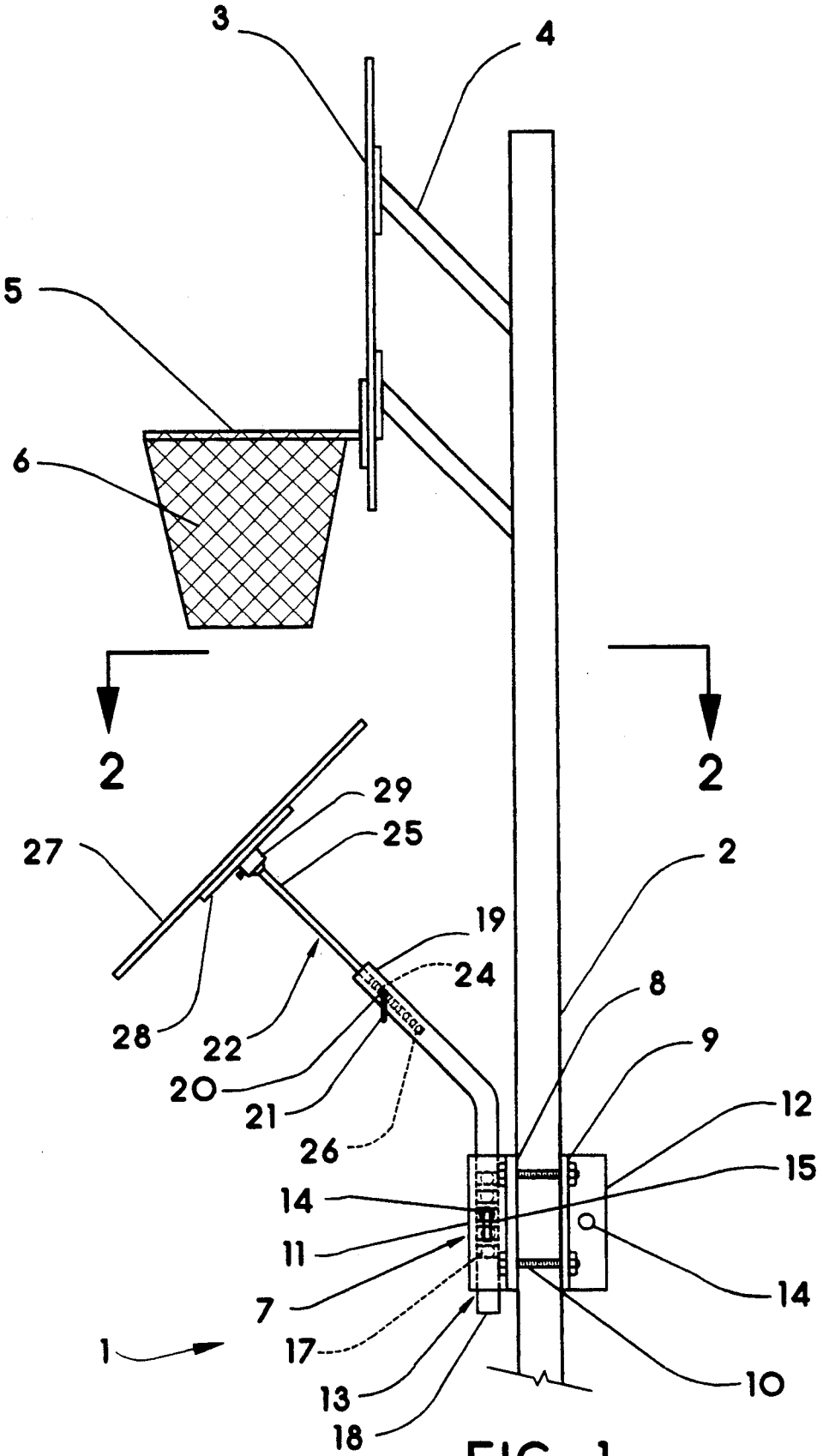
FIG. 1 is an elevation view of one embodiment of the basketball rebound device.

In the drawings many details pertaining to fabrication and maintenance utility well established in the machine construction art and not bearing upon points of novelty are omitted in the interest of descriptive clarity and efficiency. Such details may include threaded connections, lockrings, shear pins, weld lines and the like. The spreading use of electron beam welding eliminates many such features and leaves no visible distinctive lines.

Figure 2:
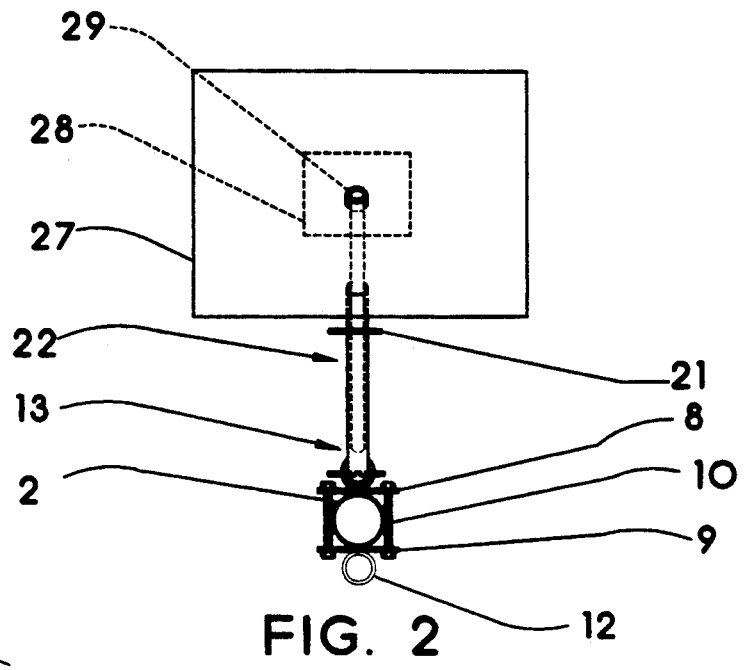
FIG. 2 is a top view of one embodiment of the basketball rebound device.
Figure 3:
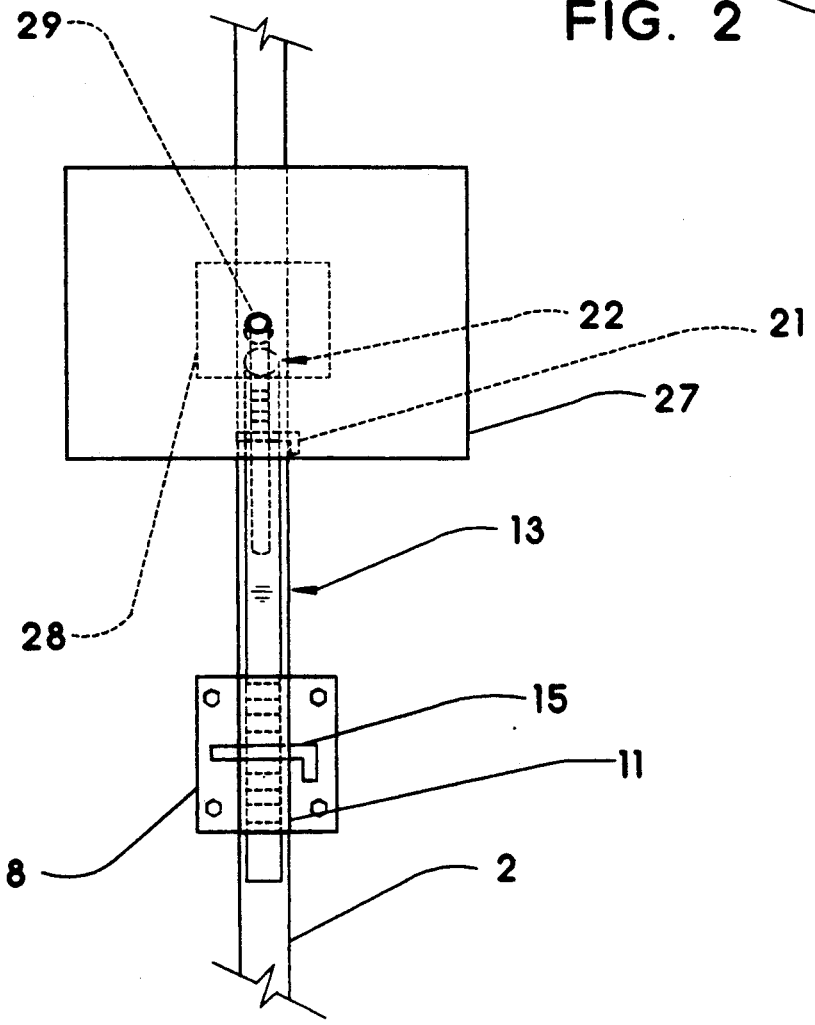
FIG. 3 is a front view of one embodiment of the basketball rebound device.

Turning now to FIGS. 1-3, a basketball rebound device 1 is shown in a first embodiment attached to goal support post 2. Support post 2 typically includes backboard 3 held in a fixed, offset position from support post 2 by stand-off members 4. Goal rim 5 is attached to backboard 3 and often includes net 6. Mounting means 7 is used to connect rebound device 1 to support post 2 and preferably comprises front and rear plates 8,9 on opposite sides of support post 2 which are connected to one another by mounting nuts and bolts 10. First sleeve 11 is fixedly attached to front plate 8, and second sleeve 12 is fixedly attached to rear plate 9. Both first and second sleeves 11,12 can be cylindrical pipe sections, square tubing, or any similar material that will allow primary support member 13 to be slidable therewithin as explained in further detail below.

At least one horizontal hole 14 is formed through both first and second sleeves 11,12 so that first lock pin 15 can be completely inserted therethrough for reasons to be explained below. Primary support member 13 preferably comprises a rigid, elongated, and hollow member having a lower end 18 and an upper end 19. The outside cross-sectional dimensions of primary support member 13 are of a size to allow primary support member 13 to slide within the inside cross-sectional dimensions of either first or second sleeve 11,12. Ideally, there should be a close enough fit between primary support member 13 and first or second sleeve 11,12 so that side-to-side motion of primary support member 13 can be minimized. Primary support member 13 also includes at least one vertical array of primary position holes 17 formed horizontally through lower end 18, one of which can be matched with hole 14 in first sleeve 11. First lock pin 15 is simultaneously inserted through hole 14 and one of primary position holes 17 to maintain a desired height position of primary support member 13 relative to first sleeve 11. Optionally, additional vertical arrays of primary position holes 17 may be included around lower end 18 so that primary support member 13 can be rotatably adjusted within first sleeve 11. If such rotatable adjustment is desired, however, the cross section of lower end 18 should be round.

Similar to hole 14 in first sleeve 11, primary support member 13 includes at least one hole 20 formed through upper end 19 so that second lock pin 21 can be completely inserted therethrough for reasons to be explained below. Secondary support member 22 preferably comprises a rigid, elongated member 22 having a lower end 24 and an upper end 25. The outside cross-sectional dimensions of secondary support member 22 are of a size to allow secondary support member 22 to slide within the inside cross-sectional dimensions of primary support member 13. Similar to the relationship between first sleeve 11 and primary support member 13, there should be a close enough fit between secondary support member 22 and primary support member 13 so that side-to-side motion of secondary support member 22 can be minimized. Secondary support member 22 also includes a linear array of secondary position holes 26 formed through lower end 24, one of which can be matched with hole 20 in primary support member 13. Second lock pin 21 is simultaneously inserted through hole 20 and one of secondary position holes 26 to maintain a desired position of secondary support member 22 relative to primary support member 13.

Upper end 25 of secondary support member 22 is fixedly attached to rebound panel 27. Alternatively, rebound panel 27 can be attached by bolts or screws to an intermediate plate 28 fixedly attached to upper end 25 of secondary support member 22. Although not critical to practicing the invention, rebound panel 27 is oriented at an angle of about 45 degrees as shown in FIG. 1. Optionally, either a 2-dimensional or 3-dimensional, lockable pivot 29, such as a ball and socket joint which incorporates a set screw, can be included between upper end 25 and rebound panel 27 so that the angular relationship between rebound panel 27 and secondary support member 22 can be adjusted to suit the needs of the individual player. In this manner, rebound panel 27 can be oriented precisely in the desired position so that shots can be made from virtually any point on the basketball court with the ball being returned directly to the player.

When competition play or practice without the basketball rebound device 1 is desired, first lock pin 15 is removed and lower end 18 is withdrawn from first sleeve 11. The rebound device 1 can then be temporarily moved by inserting lower end 18 in second sleeve 12 and using first lock pin 15 to lock the assembly in place in a manner similar to normal use.

Figure 6:
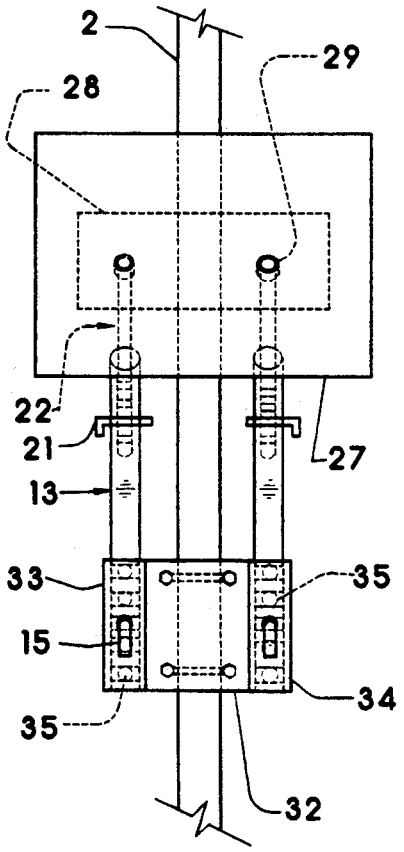
FIG. 6 is a front view of an alternate embodiment of the basketball rebound device.
Figure 4:
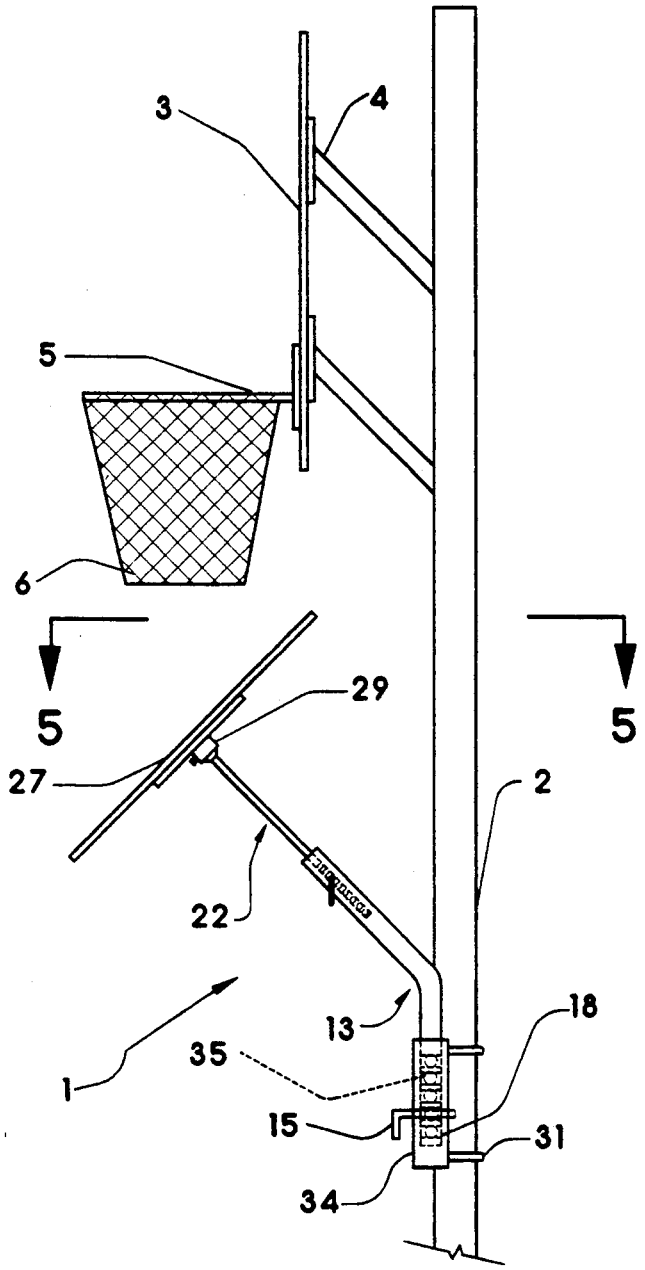
FIG. 4 is an elevation view of an alternate embodiment of the basketball rebound device.
Figure 7:
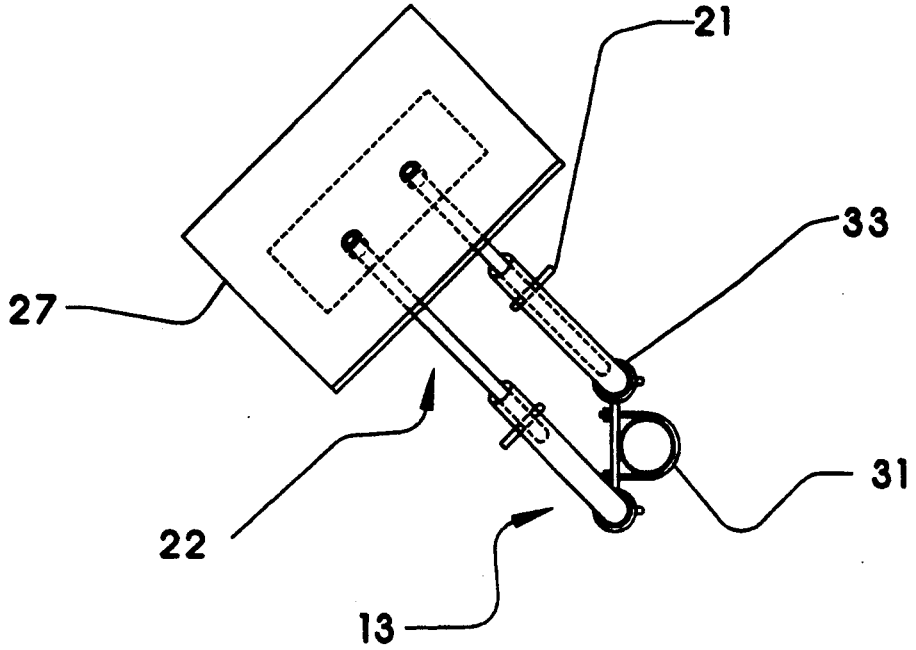
FIG. 7 is a top view of an alternate embodiment in an adjusted position.
Figure 5:
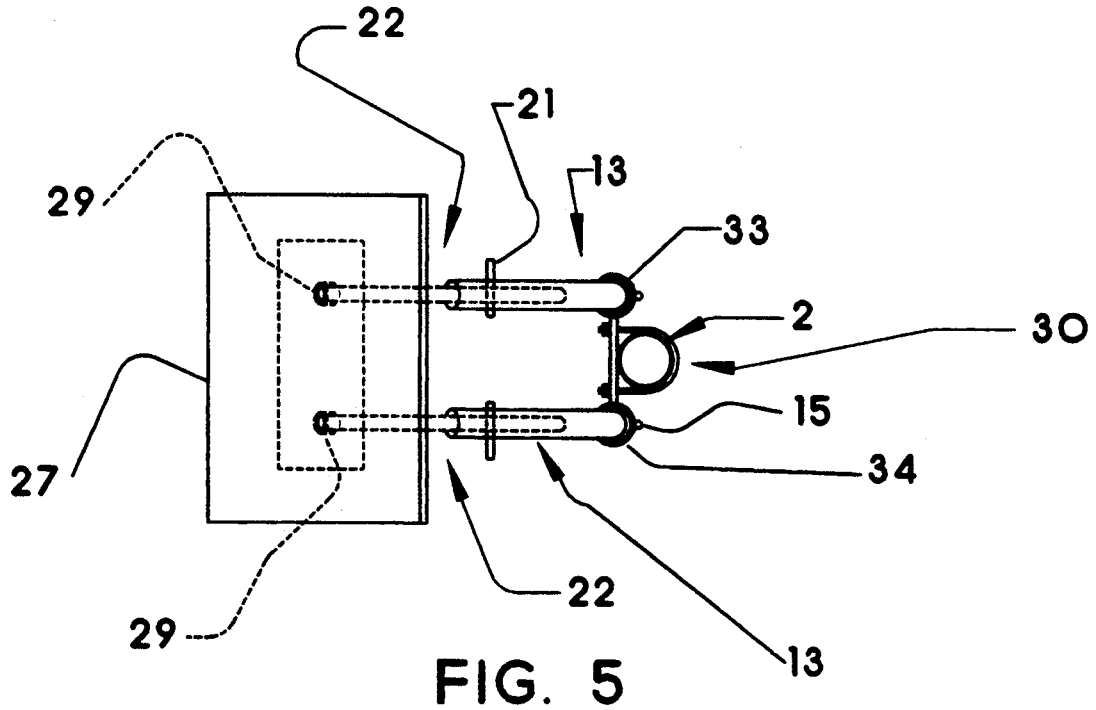
FIG. 5 is a top view of an alternate embodiment of the basketball rebound device.

In an alternate embodiment shown in FIGS. 4-6, two primary support members 13 are employed as explained below. Mounting means 30 is attached to support post 2 and generally comprises a pair of U-bolts 31 and support plate 32 attached as shown in the accompanying figures. Support plate 32 also includes first and second sleeves 33,34, both of which are similar to first sleeve 11 in the first embodiment. Primary support members 13 are placed in each of first and second sleeves 33,34 and are held in position by their respective first lock pins 15 in the manner described above for the first embodiment. However, both first and second sleeves 33,34 and lower end 18 must have round cross sections, because primary support members 13 are required to rotate relative to first and second sleeves 33,34 as well as to slide vertically therein. Also, each primary support member 13 of the alternate embodiment includes multiple vertical arrays of primary position holes 35 spaced equiangularly around lower end 18, similar to the first embodiment described above. Preferably, the angular spacing between each array should be at least 30 degrees. This arrangement now permits primary support members 13 to be adjusted both in height and angular position relative to goal rim 5.

Secondary support members 22 are slidably disposed within their respective primary support members 13 in a manner identical to that described in the first embodiment, except for there being two of each part. Rebound panel 27 is attached to upper ends 25 of secondary support members 22 by lockable pivots 29, such as ball and socket joints.

In operation of the alternate embodiment, the height and angular positions of primary support members 13 are first set by choosing the appropriate primary position hole 35 for each one, and then fixing that position relative to sleeves 33,34 by inserting first lock pins 15. Next, the effective lengths of secondary support members 22 are set by using second lock pins 21 in the desired secondary position holes 26. Pivots 29 are finally used to "fine tune" the angle of rebound panel 27 to suit the particular shot for which practice is needed. When competition play or practice without the basketball rebound device 1 is desired, first lock pins 15 are removed and the entire device 1 can be temporarily removed from sleeves 33,34 or stored within sleeves 33,34 on the opposite side of post 2.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. In combination with a basketball goal assembly, said goal assembly including a support post, a backboard attached to said support post, and a forwardly extending goal rim attached to said backboard for receiving a basketball thrown by a player, a basketball rebound device, comprising:

(a) a rebound panel positioned beneath said rim and adapted to deflect said basketball away from said goal assembly upon said basketball being received through said rim;

(b) a mounting brace attachable to said post, said mounting brace having a front portion and a rear portion, and including a first vertical sleeve attached to said front portion;

(c) a primary support member, having a lower end and a hollow upper end, wherein said lower end is slidably matable within said first vertical sleeve and wherein said upper end extends away from said support post;

(d) first locking means operatively connected between said first vertical sleeve and said lower end of said primary support member for locking said primary support member relative to said first sleeve;

(e) a secondary support member, having a first end and a second end, wherein said first end is slidably matable within said hollow upper end of said primary support member;

(f) second locking means operatively connected between said upper end of said primary support member and said second end of said secondary support member for locking said secondary support member relative to said primary support member; and (g) lockable pivot means operatively connected between said rebound panel and said second end of said secondary support member for allowing angular manipulation of said rebound panel relative to said secondary support member.

2. A device according to claim 1, further comprising a second vertical sleeve attached to said rear portion of said mounting brace opposite said first vertical sleeve.

3. A device according to claim 1, wherein said first locking means comprises:

(a) a pin hole formed horizontally through said first vertical sleeve;

(b) a vertical array of position holes formed through said lower end of said primary support member and alignable with said pin hole; and (c) a removable lock pin operatively disposed within said pin hole and one of said position holes.

4. A device according to claim 1, wherein said second locking means comprises:

(a) a pin hole formed through said upper end of said primary support member;

(b) a linear array of position holes formed through said first end of said secondary support member and alignable with said pin hole; and (c) a removable lock pin operatively disposed within said pin hole and one of said position holes.

5. A device according to claim 1, wherein said lockable pivot means comprises a ball and socket joint having a set screw for urging said ball against said socket.

6. In combination with a basketball goal assembly, said goal assembly including a support post, a backboard attached to said support post, and a forwardly extending goal rim attached to said backboard for receiving a basketball thrown by a player, a basketball rebound device, comprising:

(a) a rebound panel positioned beneath said rim and adapted to deflect said basketball away from said goal assembly upon said basketball being received through said rim;

(b) a mounting brace attachable to said post, said mounting brace having a front portion and a rear portion, and including a pair of vertical sleeves attached to said front portion;

(c) a pair of primary support members, each having a lower end and a hollow upper end, wherein said lower ends are slidably matable within said pair of vertical sleeves and wherein said upper ends extend away from said support post;

(d) a pair of first locking means, each operatively connected between one of said vertical sleeves and a corresponding said lower end of a corresponding said primary support member for locking said primary support member relative to a corresponding said vertical sleeve;

(e) a pair of secondary support members, each having a first end and a second end, wherein said first end is slidably matable within said hollow upper end of a corresponding said primary support member;

(f) a pair of second locking means, each operatively connected between said upper end of each of said primary support members and said second end of each of said secondary support members for locking said secondary support members relative to corresponding said primary support members; and (g) a pair of lockable pivot means, each operatively connected between said rebound panel and each of said second ends of said secondary support members for allowing angular manipulation of said rebound panel relative to said secondary support members.

7. A device according to claim 6, wherein each said first locking means comprises:

(a) a pin hole formed horizontally through one of said vertical sleeves;

(b) an array of position holes formed through said lower end of said corresponding primary support member and alignable with said pin hole; and (c) a removable lock pin operatively disposed within said pin hole and one of said position holes.

8. A device according to claim 6, wherein each said second locking means comprises:

(a) a pin hole formed through said upper end of said corresponding primary support member;

(b) a linear array of position holes formed through said first end of said corresponding secondary support member and alignable with said pin hole; and (c) a removable lock pin operatively disposed within said pin hole and one of said position holes.

9. A device according to claim 6, wherein each said lockable pivot means comprises a ball and socket joint having a set screw for urging said ball against said socket.

* * * * *